US006880824B2

(12) United States Patent
Thinnes

(10) Patent No.: US 6,880,824 B2
(45) Date of Patent: Apr. 19, 2005

(54) APPARATUS FOR CONTROLLING PLAY OF A PROGRESSIVELY OPERATED LOTTERY-TYPE GAME

(75) Inventor: William Everett Thinnes, Wilmette, IL (US)

(73) Assignee: Douglas Press, Inc., Bellwood, IL (US)

( * ) Notice: Subject to any disclaimer, the term of this patent is extended or adjusted under 35 U.S.C. 154(b) by 0 days.

(21) Appl. No.: 10/617,072

(22) Filed: Jul. 10, 2003

(65) Prior Publication Data

US 2004/0007816 A1 Jan. 15, 2004

Related U.S. Application Data

(60) Provisional application No. 60/394,973, filed on Jul. 10, 2002.

(51) Int. Cl.[7] ..... A63F 3/06

(52) U.S. Cl. ..... 273/139; 273/138.1; 283/903; 283/901

(58) Field of Search ..... 273/139, 269, 273/274, 138.1; 283/903, 901

(56) References Cited

U.S. PATENT DOCUMENTS

| | | | | |
|---|---|---|---|---|
| 3,900,219 A | | 8/1975 | D'Amato et al. | 283/6 |
| 4,033,611 A | | 7/1977 | Johnsen | 283/6 |
| 4,740,016 A | | 4/1988 | Konecny et al. | 283/903 |
| 4,943,090 A | | 7/1990 | Fienberg | 273/139 |
| 5,046,737 A | | 9/1991 | Fienberg | 273/139 |
| 5,092,598 A | | 3/1992 | Kamille | 273/139 |
| 5,158,293 A | | 10/1992 | Mullins | 273/139 |
| 5,193,815 A | | 3/1993 | Pollard | 273/269 |
| 5,407,200 A | | 4/1995 | Zalabak | 273/139 |
| 6,309,298 B1 | * | 10/2001 | Gerow | 463/20 |

* cited by examiner

*Primary Examiner*—Benjamin Layno
(74) *Attorney, Agent, or Firm*—Greenberg Traurig LLP.

(57) ABSTRACT

Disclosed is an apparatus for controlling the play of progressively operated lottery-type game systems wherein at least one selected player becomes eligible to play for a bonus award which if not awarded to or won by a player rolls over and is added to the bonus award for a subsequently played game, and specifically an apparatus for awarding an initial or an accumulated bonus award when the bonus award equals or exceeds a predetermined amount.

19 Claims, 6 Drawing Sheets

APPARATUS FOR CONTROLLING PLAY OF A PROGRESSIVELY OPERATED LOTTERY-TYPE GAME

This application claims benefit of U.S. Provisional 60/394,973 filed Jul. 10, 2002.

BACKGROUND OF THE INVENTION

1. Field of the Invention

The present invention relates generally to lottery-type game systems wherein at least one selected player becomes eligible to play for a bonus or jackpot award which if not awarded to or won by the player rolls over and is added to the bonus award for a subsequently played game, and specifically to an apparatus for controlling or stopping game play when the bonus award reaches or exceeds a predetermined amount.

2. The Prior Art

One type of lottery-type game system which has proven quite popular with players are the so-called break-open or jar ticket games. In this type of game, players purchase playing cards or tickets for a relatively nominal sum. Each playing card displays game symbols, selected ones of which correspond to award values. In a typical configuration, each playing card comprises a lamination of an upper ply and a lower ply of material, such as paper, with the game symbols printed on the inside surface of the lower ply. The game symbols are thus initially sealed and hidden from view by the upper ply and are revealed only by "breaking open" one or more flap-like portions die-cut into the upper ply. Game symbols may also be hidden by other means including scratch-off, optical and other covering methods commonly known in the art.

As will be appreciated, affording players an opportunity to win awards in different ways enhances the entertainment value of a game. One form of game provides for selected players to become eligible for a bonus award, with at least one of these players, in turn, having an opportunity to win the bonus. Providing game players the opportunity to win bonuses enhances the entertainment value of the game. Implementation of such bonus awards is accomplished through the use of a master game card which is associated with the particular set of playing cards. An example of such a game system is illustrated in U.S. Pat. No. 5,046,737.

The present invention relates to the play of a progressively operated game having one or more game levels, and wherein any bonus amount which is not won by a player is carried forward and is added to the bonus amount eligible to be won in a subsequently played game. It is of course conceivable that all or a portion of bonus amounts may roll over repeatedly thereby increasing the total bonus or "jackpot" amount. A total bonus or jackpot can indeed reach a considerable sum of money which may be won by a player investing a relatively low amount in connection with the purchase of a game card.

While such types of game may be very entertaining, it is frequently desirable, pursuant to social pressures or state law, to limit play of such games to impose a maximum bonus amount. Such limits are often imposed out of concern that excessively large bonus or jackpot prizes are against the public good and/or promote possible abuse or cheating on the part of game operators and/or players.

Accordingly, it is useful to be able to provide for a progressively played game and yet still limit the maximum bonus award without unduly affecting game play and player enjoyment.

It is thus one object of the present invention to provide for a progressive type lottery game which is played in a manner which provides for awarding an initial or an accumulated bonus or jackpot when the bonus or jackpot award equals or exceeds a predetermined amount.

It is an object of an alternative embodiment the present invention to provide for controlling the play of a progressive type lottery game whereby a portion of the bonus or jackpot available to be won is distributed such that the bonus or jackpot does not exceed a predetermined amount.

These and other desirable characteristics of the present invention will become apparent in view of the present specification, including claims, and drawings.

SUMMARY OF THE INVENTION

The present invention comprises an apparatus for controlling play of a progressively operated lottery type card based game. A plurality of playing cards having one or more game symbols displayed thereon are provided for purchase by game players. A master game card is provided for use in conjunction with the plurality of playing cards. At least one of the master game card and the plurality of playing cards has displayed thereon means for establishing the eligibility of a plurality of selected game players having playing cards displaying predetermined selected ones of the game symbols. The master game card of the illustrated embodiment further includes means for identifying at least one of the selected players which are concealed by selectively removable means prior to establishing all of the selected game players. The master game card further includes award identifying means comprising a plurality of award values displayed on the master game card, and selectively removable means for concealing the award values, so that at least one of the selected game players identified by the identifying means can determine the award to be received by removing the concealing means associated with the award values.

A jackpot is provided for an initial game or is accumulated from one or more prior games. The master game card additionally includes a second award identifying means for establishing the identity of at least one game player, and selectively removable means for concealing the second award identifying means. The concealing means associated with the second award identifying means is manipulated, moved or removed to reveal the identity of at least one game player who is awarded an award from an accumulated jackpot only when the accumulated jackpot amount reaches or exceeds a predetermined maximum amount and is not awarded to at least one of the selected game players identified by the identifying means.

In the preferred embodiment of the present invention the second award identifying means identifies one eligible game player from any selected game players though two or more eligible game players may be identified. Alternatively, the second award identifying means identifies one player from among all game players who purchased a game card.

In the preferred embodiment, the selectively removable means for concealing the second award identifying means comprises a die-cut flap which obscures the identity of a game player until lifted or removed. Alternatively, the selectively removable means for concealing the second award identifying means comprises a scratch-off coating which obscures the identity of a game player until removed.

The master game card has displayed thereon indicia which informs both the game operator and game players that the selectively removable means for concealing the second award identifying means is to be lifted or removed when the progressive award amount reaches or exceeds a predetermined maximum amount and has not been awarded to a game player. Indicia is included on the selectively removable means for concealing the second award identifying means. The indicia may comprise a stop sign symbol or other indicia which expressly indicates a dollar amount reminding the game operator and game players that the jackpot bonus award is to be awarded when the amount reaches or exceeds a predetermined maximum amount and has not been awarded to a game player thus triggering removal of the concealing means.

In one embodiment, the master game card displays the accumulated jackpot, comprising a dollar value, as well as the identity of eligible game players who may be represented by a plurality of game symbols or other indicia.

In the preferred embodiment, at least one game player is awarded the entire accumulated jackpot when the accumulated jackpot amount reaches or exceeds a predetermined maximum amount and is not awarded to at least one of the selected game players identified by the identifying means. Alternatively, at least one game player is awarded only the amount from the accumulated jackpot which exceeds the predetermined maximum amount when the jackpot is not awarded to at least one of the selected game players identified by the identifying means.

DETAILED DESCRIPTION OF THE DRAWINGS

Figure 1:
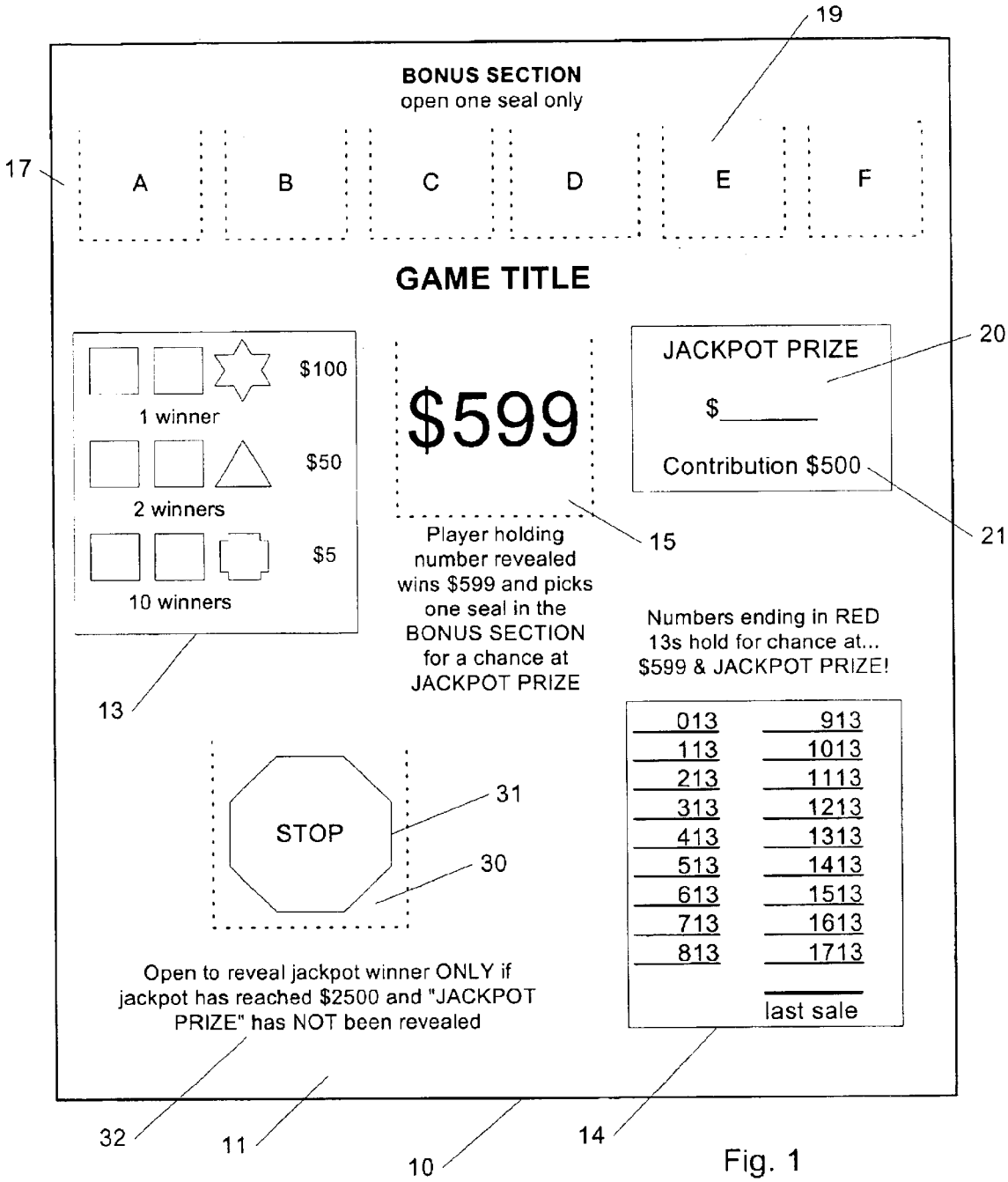
FIG. 1 is plan view illustrating the top facing ply of a master game card.

While the present invention is susceptible of embodiment in various forms, there is shown in the drawings and will hereinafter be described several embodiments of the invention, with the understanding that the present disclosure is to be considered as an exemplification of the invention, and is not intended to limit the invention to the specific embodiments illustrated.

Figure 2:
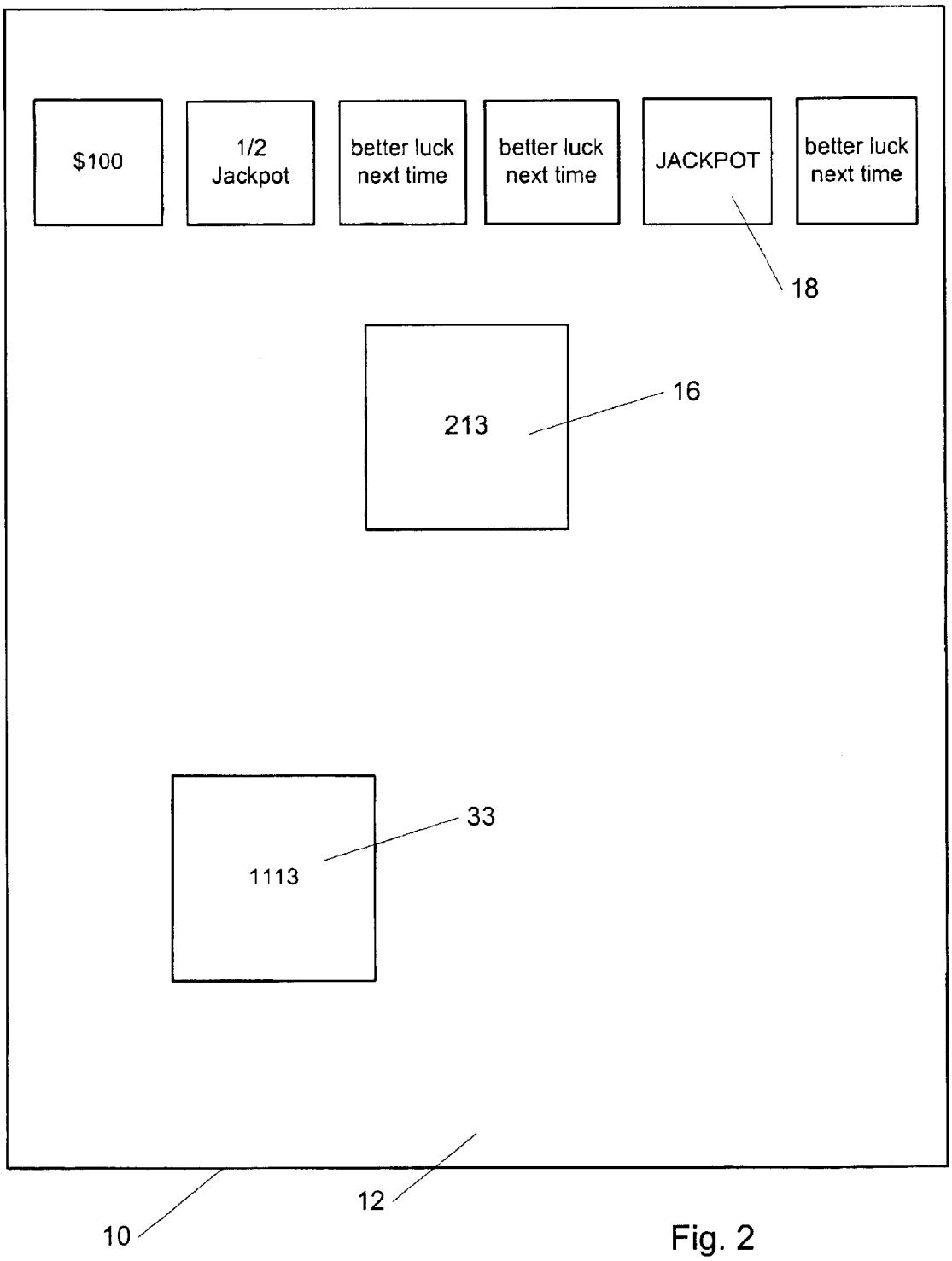
FIG. 2 is a plan view illustrating the underlying ply of a master game card, the printed portions of which are aligned with die cut openings in the top ply of the game card.
Figure 3:
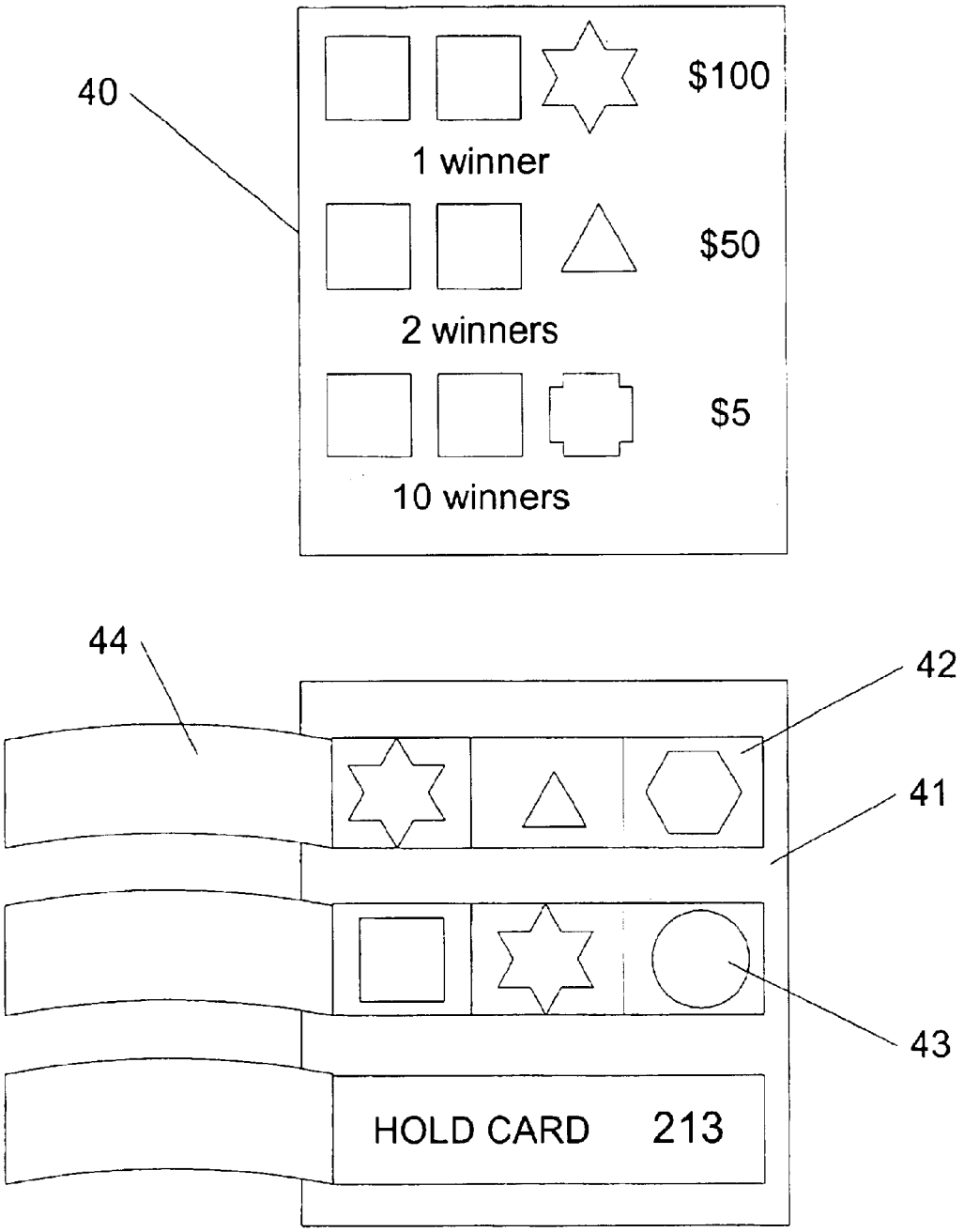
FIG. 3 illustrates one form of a playing card for use in the present game system.

FIGS. 1, 2 and 3 illustrate a master game card 10 and playing card 40 embodying the present game system. Playing card 40 is a typical card useable in the present game system which includes a substantial plurality of such playing cards. Each of these playing cards is purchased by a game player, with certain ones of the players being eligible to participate in selection of a bonus award on the master game card 10, with or without prior or subsequent opportunity to win prizes.

Each of the playing cards 40 preferably comprise a lamination of an upper ply and a lower ply of material 41 and 42, such as paper or the like. Each of the playing cards display game symbols 43, which symbols are displayed on the inside surface of the lower ply 42 of the card. This type of card is typically referred to as a "break-open" playing card, in that flap-like portions 44 of the upper ply 41 can be selectively lifted or removed from each of the game symbols 43 in order to reveal the game symbols after the card has been purchased. However, it will be understood that a game embodying the principles of the present invention may include playing cards and a master game card otherwise configured, such as including "scratch-off" arrangements for initially concealing game symbols.

In its first level of play, the present game system provides awards to those players having cards which display predetermined winning award symbols. In its one or more additional levels of play, the present system permits selected ones of the players to become eligible for at least one bonus award, and wherein at least one of the players plays for the bonus, through use of the master game card 10.

The master game card 10 preferably comprises a lamination of an upper ply 11 and a lower ply of material 12. To assist players in ascertaining winning cards at the first level of play, an image 13 of winning symbols is preferably provided on the front exposed surface of the master game card. Image 13 in the embodiment illustrated in FIG. 1 comprises a symbolic representation of a specimen example of playing card 40.

A second level of play of the present game system entails establishing selected game players who become eligible for the bonus award, with these players then listed on the master game card 10 in the illustrated embodiment. To this end, the master game card 10 includes a list arrangement 14 for listing the selected, eligible players, such as by handwriting in blanks provided. In the illustrated embodiment, the eligibility of these selected players is established by those players having cards 40 having predetermined selected ones of the game symbols, be they graphics, letters or numbers. In the illustrated embodiment, such predetermined game symbols comprise numeric designations (i.e., 013, 113, 213, etc.). In addition, the illustrated game permits the player who purchases the last playing card of the set to be eligible for the bonus award by entry in the "last sale" listing.

The master game card 10 further includes an arrangement whereby at least one of the listed, eligible players is identified, with that player then being eligible to play for the bonus award. This is provided by at least one bonus player identifier 16 on the inside surface of the lower ply 12 of the master game card, with this identifier concealed by a selectively removable flap-like portion 15 (shown partially cutaway in FIG. 4) of the upper ply 11 of the master game card. As will be noted, the identifier 16 corresponds to a predetermined one of the selected game symbols, such as the numeric symbol "213", or to the "last sale" designation, if provided.

As will be appreciated, the bonus player identifier 16 is not revealed, such that flap 15 is not lifted or removed, until all of the eligible selected players have been established, and entered at listing 14, if provided. When the identifier 16 is revealed by lifting or removing flap 15, that one player (in the embodiment illustrated) who possesses the corresponding card then becomes eligible for the bonus award, which award is determined by the "bonus section" 17 of the master game card 10. In addition, the player so identified may win a predetermined award (i.e., $599.00 in the illustrated embodiment). While the illustrated embodiment includes a single identifier 16, a plurality of such identifiers can alternately be provided, whereby eligible players may become further eligible to play the "bonus section".

The bonus section 17 of the master game card 10 provides the third level of play of the present system, and identifies a plurality of award values 18 printed on the inside surface of lower ply 12, each of which is concealed by a respective flap-like portion 19 of the upper ply 11. It is contemplated that the bonus player will open only one of the flap-like portions 19. In an alternative embodiment, one or more players may open one or more flap-like portions 19. It is further contemplated that only one of the award values 18 will correspond to the "bonus award", while the other awards may be zero value or less than the total bonus award. Optionally, more than one of the award values 18 may correspond to the "bonus award". The value of the "bonus award" is preferably prominently displayed at region 20 on the master game card so that all game players are aware of the potential bonus they might win.

One feature of the illustrated master game card 10 is the inclusion of a pre-printed indication 21 indicating the amount of the "bonus award contribution" for a given game and is included to deter abuse by a game operator who may seek to better his or her return by understating the bonus award amount. In the embodiment illustrated the bonus award (labeled "jackpot prize") is left blank, the purpose of which is further explained below.

Figure 4:
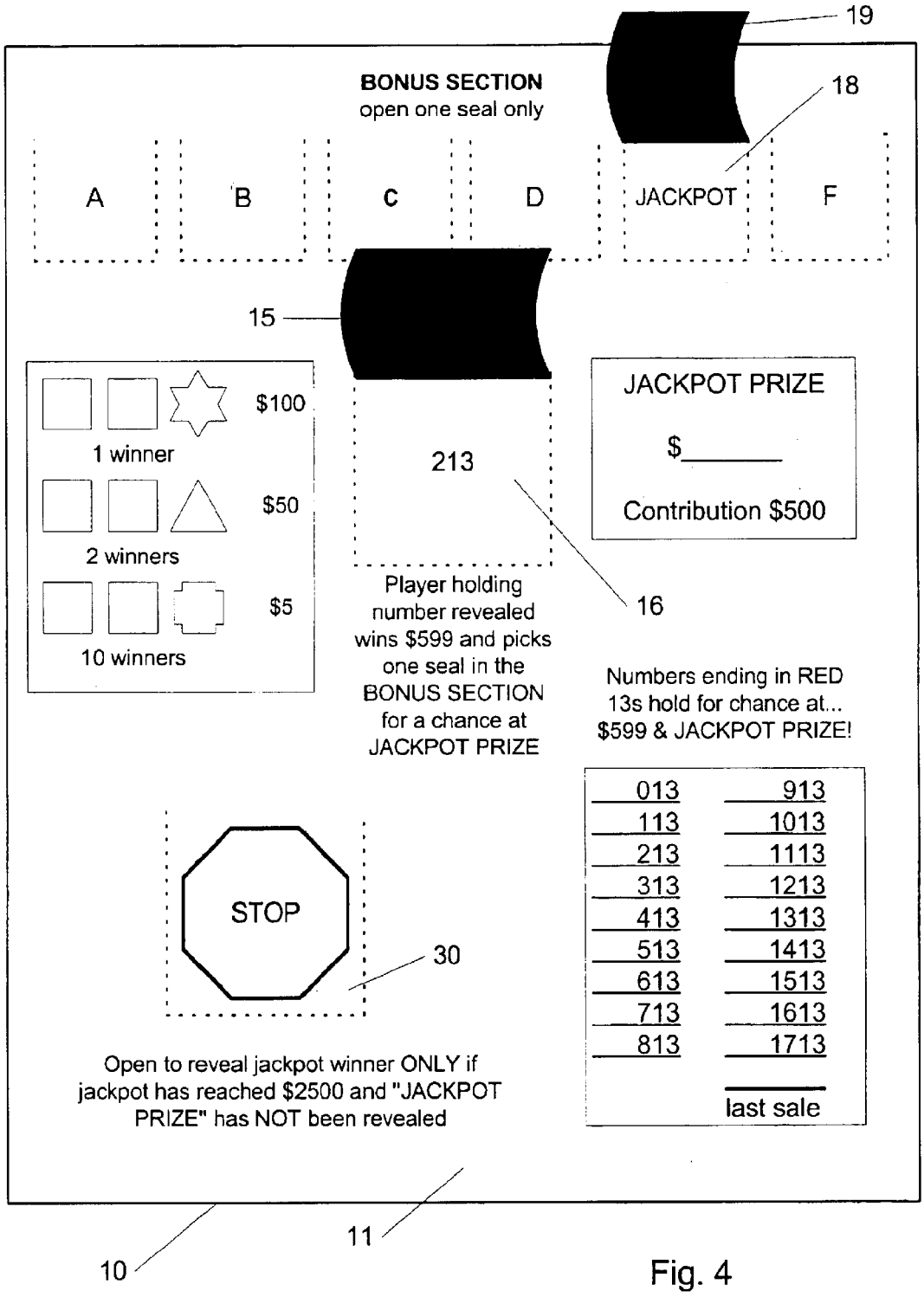
FIG. 4 is plan view illustrating a master game card and specifically illustrating a bonus flap opened to reveal that the jackpot has been won.
Figure 5:
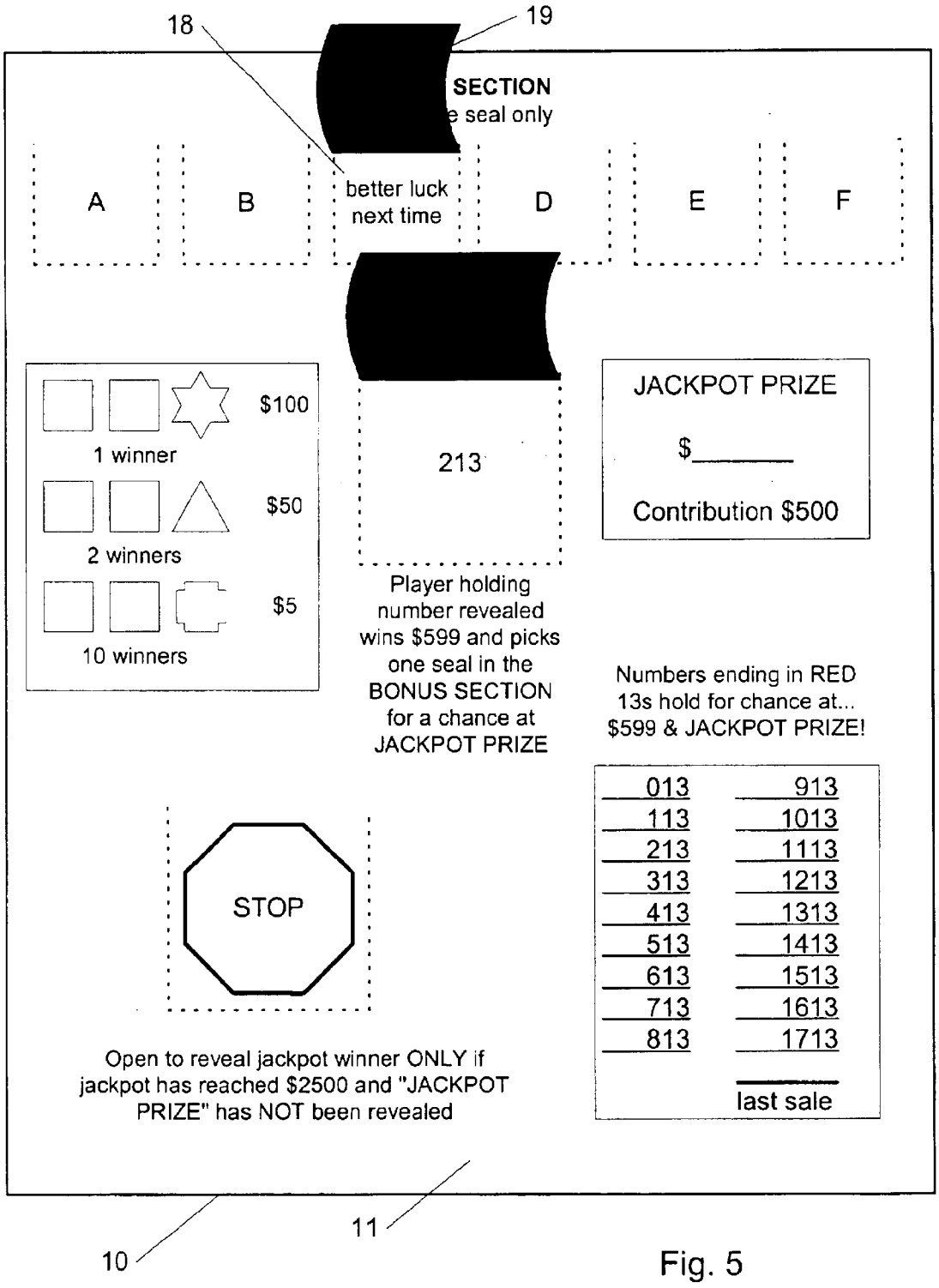
FIG. 5 is plan view illustrating a master game card and specifically illustrating a bonus flap opened to reveal that the jackpot has been not been won.

In one intended mode of play, the game ends when the bonus player selects and reveals one of the bonus prizes by lifting one flap 19, regardless of the amount of bonus amount, if any, that is won. In one instance, the bonus player may select a particular flap 19 which when opened reveals the indication that the bonus player has won the full bonus amount or jackpot 18, as illustrated in FIG. 4. In another instance, the bonus player may select a flap 19 which when opened reveals that the bonus player has won either a lesser prize or, as illustrated in FIG. 5, no prize at all, whereby un-awarded bonus amounts or jackpots are carried over and accumulated.

However, it is common practice in some states for operators of the described game system to operate the game on a progressive basis whereby any bonus amount which is not won by a bonus player is carried forward and added to the bonus amount for the next game session—toward providing for a progressive play mode. In such mode of play, players purchase a new playing card which is from another set of cards specifically associated with a new master game card. The game operator will then complete the jackpot prize blank 20 on a next played master game card 10 by indicating an increased bonus amount. For example, a $500 bonus prize which carries over to a next game will be reflected by a subsequent bonus amount (or jackpot prize) of $1000. In another embodiment, if for example a lesser bonus amount of $20 was won, $480 would roll over to give rise to a $980 bonus amount for the next game, e.g. $480 plus another $500 bonus award contribution. Typically, the progressive play of the game would continue until the bonus amount is won in full.

The play of the lottery-type of game described herein is governed by the laws and regulations of one or more governmental agencies at the state level. Some states, in fact, altogether prohibit the progressive play of the present type of game, in part out of a concern that repeatedly un-awarded bonus amounts when rolled over and over create a jackpot that is of such magnitude so as to be deemed against the public good or contrary to state law.

One mechanism for mitigating the perceived harm associated with unlimited progressive bonus amounts is to institute a legislatively mandated cap on the total bonus amount. Such limits are typically considered unworkable inasmuch as they rely upon the voluntary participation and cooperation of game operators—operators who may be perceived as having a greater motivation to cheat players as bonus amounts increase.

The present invention thus comprises an apparatus for controlling or stopping the play of a progressively operated lottery-type game system. To that end FIG. 1 of the drawings includes a flap-like portion 30 which, as shown, bears the indication 31 which reads "stop". Printed instructions 32 instruct the game operator and also gives notice to all players that flap 30 is to be opened when the bonus amount has not been won but where the bonus amount has reached a predetermined amount, e.g. when the indicia "jackpot" has not been revealed in bonus area 17 by the eligible bonus player selecting a flap 19.

The mode of a pure progressive game play is thus modified according to the embodiment illustrated as follows. The mode of play indeed continues in a progressive manner as described above, except that at the end of each game which results in a roll over, due to there being no bonus winner of the total amount, the game operator is to determine whether the bonus amount for the game just completed meets or exceeds a predetermined amount. If the jackpot bonus for the game just completed has not met or exceeded the predetermined amount, the game can continue and the bonus amount increased as described above. However, if the jackpot bonus amount for the game just completed did meet or exceed the indicated predetermined amount, the operator is instructed to lift flap 30 to reveal bonus winner identifier 33. The jackpot bonus amount is then awarded to the player with the corresponding player identifier as listed in area 14. Thus the progressive game is halted and the bonus prize awarded. In an alternative embodiment of the present invention, the amount awarded to a player need not be the entirety of the jackpot bonus. Instead, the amount awarded is equal to the amount of the jackpot bonus which exceeds the predetermined amount. Accordingly, the total jackpot bonus available to be won in any one game never exceeds the predetermined amount.

While the player identity appearing under flap 30 in the foregoing embodiment is one of the one or more players listed on list 14, this need not be the case. For example, some other identifier can appear under flap 30, such as, but not limited to, a series of symbols which appears on another of the player cards 40 not held by one of the listed eligible players or another identifier which uniquely identifies a holder of one player card 40.

Figure 6:
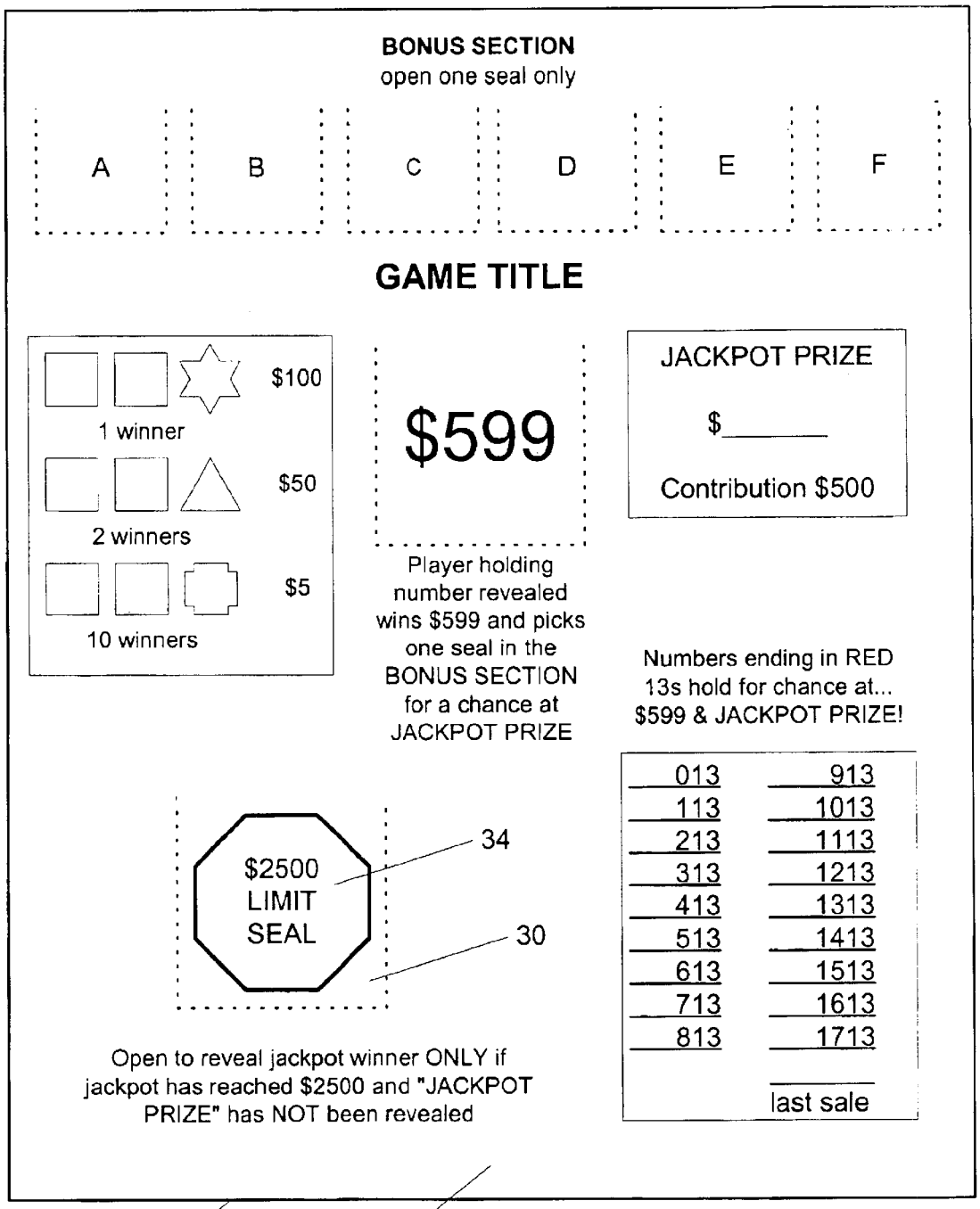
FIG. 6 is a plan view illustrating another embodiment of a master game card.

In one embodiment, the indication 31 resembles a stop sign which readily reminds the operators and players of the limited progressive play mode, as in FIG. 1, while another indication 34 may further highlight the dollar amount limit in force, as in FIG. 6

As will be appreciated, variations of the present system can be made within the context of the present invention. Indeed, while a three level mode of play is described, the present invention is applicable to other modes of game play. Accordingly, a winning player card or ticket 40 can directly identify an eligible player who proceeds to the bonus section to select and lift a bonus flap 19 for a chance to win a progressive jackpot—without any prize being won prior to becoming eligible for the bonus level of play. The game features of the present invention are equally applicable to one or two level games as they are to a three or more level game.

The foregoing description and drawings merely explain and illustrate the invention and the invention is not limited thereto, as those skilled in the art who have the disclosure before them will be able to make modifications and variations therein without departing from the scope of the invention.

What is claimed is:

1. An apparatus for controlling play of a progressively operated lottery type card based game, the apparatus comprising:

a plurality of playing cards which can be purchased by game players each of which having one or more game symbols displayed thereon;

a master game card for use in conjunction with the plurality of playing cards;

at least one of the master game card and the plurality of playing cards having displayed thereon means for establishing the eligibility of one or more selected game players having playing cards displaying predetermined selected ones of the game symbols, at least one of the master game card and the plurality of playing cards including means for identifying at least one of the selected game players, and selectively removable elements for concealing the identifying means prior to establishing the selected game players;

the master game card further including first award identifying means comprising a plurality of award values displayed on the master game card, and selectively removable elements for concealing the award values, so that the at least one of the selected game players identified by the first award identifying means can determine the award to be received by removing the concealing elements associated with the award values;

an accumulated jackpot established from jackpot contributions from one or more games prior to the play of the master game card;

indicia on the master game card for identifying a maximum allowed jackpot value;

the master game card further including a second award identifying means for establishing the identity of at least one game player, and selectively removable element for concealing the second award identifying means which concealing element is removed to reveal the identity of the at least one game player who is awarded an award from the accumulated jackpot when the accumulated jackpot amount equals or exceeds the maximum allowed jackpot value and has not been awarded to at least one of the selected game players identified by the first award identifying means.

2. The invention according to claim 1 wherein the second award identifying means identifies one selected game player.

3. The invention according to claim 1 wherein the second award identifying means identifies one player among all players who purchased a game card.

4. The invention according to claim 1 wherein the selectively removable element for concealing the second award identifying means comprises a die-cut flap which obscures the identity of a game player until revealed.

5. The invention according to claim 1 wherein the selectively removable element for concealing the second award identifying means comprises a scratch-off coating which obscures the identity of a game player until revealed.

6. The invention according to claim 1 wherein the master game card has displayed thereon indicia which informs both the game operator and game players that the selectively removable means is to be removed only when the accumulated jackpot award amount reaches or exceeds the maximum allowed jackpot value and is not awarded to a game player.

7. The invention according to claim 1 wherein the selectively removable element for concealing the second award identifying means includes indicia comprising a stop sign symbol toward reminding the game operator and game players that the accumulated jackpot bonus award is to be awarded when the amount reaches or exceeds the maximum allowed jackpot value and is not awarded to a game player.

8. The invention according to claim 1 wherein the selectively removable element for concealing the second award identifying means includes indicia which expressly indicates the maximum dollar amount of the accumulated jackpot award which triggers removal of the concealing element of the second award identifying means.

9. The invention according to claim 1 wherein the selectively removable element for concealing the second award identifying means includes indicia which informs both the game operator and game players that the element is to be removed only when the accumulated jackpot amount reaches or exceeds the maximum allowed jackpot value and is not awarded to a game player.

10. The invention according to claim 1 wherein the jackpot comprises a dollar value.

11. The invention according to claim 1 wherein the master game card has displayed thereon means for listing the identity of eligible game players.

12. The invention according to claim 1 wherein the identity of eligible game players is represented by game symbols.

13. The invention according to claim 1 wherein at least one game player is awarded the entire accumulated jackpot value when the accumulated jackpot amount equals or exceeds maximum allowed jackpot value and is not awarded to at least one of the selected game players identified by the identifying means.

14. The invention according to claim 1 wherein at least one game player is awarded the amount from the accumulated jackpot which exceeds the maximum allowed jackpot value when the jackpot is not awarded to at least one of the selected game players identified by the identifying means.

15. A method of playing a lottery-type game having a progressive jackpot, comprising:

a) providing a plurality of playing cards to game players, each of the playing cards having at least one game symbol displayed thereon, and a master game card for use in association with the playing cards, the master game card having at least one first game symbol displayed thereon; at least one first concealment element initially concealing the at least one first game symbol of the master game card; a plurality of award identifying symbols, each award identifying symbol having an associated award concealing element initially concealing the award identifying symbol; at least one second game symbol displayed thereon; and at least one second concealment element initially concealing the identity of at least one game player;

b) setting a maximum jackpot value to be awarded to a winning game player;

c) distributing the playing cards to a plurality of game players;

d) operating the at least one first concealment element to reveal at least one first game symbol of the master game card;

e) permitting each game player holding a playing card having a game symbol matching at least one of the at least one first game symbols to select at least one of the at least one award concealment elements to be opened to reveal the award identifying symbol associated therewith, and awarding each said game player any prize identified by the associated award identifying symbol;

f) accumulating additional value into a jackpot when the entire jackpot is not awarded as a prize in step e);

g) repeating steps a), b), c), d), e) and f) until the entire jackpot is awarded as a prize in step e) or the accumulated jackpot reaches the maximum allowed jackpot value;

h) operating the at least one second concealment element to reveal the identity of at least one game player when the accumulated jackpot reaches at least the maximum allowed jackpot value and i) awarding the entire accumulated jackpot value to the at least one player whose identity is revealed upon operating the at least one second concealment element.

16. The invention according to claim 15, wherein the master game card further includes a plurality of eligibility game symbols displayed thereon, at least one of the eligibility game symbols matching at least one of the first game symbols of the master game card.

17. The invention according to claim 15, wherein at least one of the at least one first concealment element, the award concealment elements, and the at least one second concealment element comprises a die-cut flap.

18. The invention according to claim 15, further comprising the step of displaying the accumulated jackpot value on the master game card.

19. The invention according to claim 15, wherein the master game card has the maximum jackpot value displayed thereon.

* * * * *